US008534346B1

(12) United States Patent
Mecozzi

(10) Patent No.: US 8,534,346 B1
(45) Date of Patent: Sep. 17, 2013

(54) FLEXIBLE HEAT EXCHANGER

(75) Inventor: Walter P. Mecozzi, Edmond, OK (US)

(73) Assignee: ClimateCraft Technologies, Inc., Oklahoma City, OK (US)

( * ) Notice: Subject to any disclaimer, the term of this patent is extended or adjusted under 35 U.S.C. 154(b) by 1430 days.

(21) Appl. No.: 11/940,656

(22) Filed: Nov. 15, 2007

Related U.S. Application Data

(60) Provisional application No. 60/866,115, filed on Nov. 16, 2006.

(51) Int. Cl.
*F24H 3/02* (2006.01)

(52) U.S. Cl.
USPC ..... 165/54; 165/66; 165/86; 165/96; 165/909

(58) Field of Classification Search
USPC ..... 65/81, 86, 96, 173, 175; 165/81, 165/86, 96, 173, 175, 54, 66, 909
See application file for complete search history.

(56) References Cited

U.S. PATENT DOCUMENTS

| | | | | |
|---|---|---|---|---|
| 1,399,146 | A | 12/1921 | Naujoks | |
| 2,056,492 | A * | 10/1936 | Stout | 165/137 |
| 3,000,193 | A * | 9/1961 | Crider | 165/86 |
| 3,097,507 | A * | 7/1963 | Makuh | 165/86 |
| 3,380,516 | A * | 4/1968 | Kaye | 165/81 |
| 3,689,972 | A * | 9/1972 | Mosier et al. | 165/175 |
| 3,732,916 | A | 5/1973 | Cope | |
| 4,040,478 | A | 8/1977 | Pogson et al. | |
| 4,114,683 | A | 9/1978 | Verlinden | |
| 4,202,407 | A * | 5/1980 | Woitowitz | 165/176 |
| 4,236,288 | A * | 12/1980 | Rohner | 29/890.032 |
| 4,271,900 | A | 6/1981 | Reitz | |
| 4,367,793 | A | 1/1983 | MacIntosh | |
| 4,402,358 | A * | 9/1983 | Wolf | 165/276 |
| 4,559,996 | A | 12/1985 | Andrieux | |
| 4,588,026 | A | 5/1986 | Hapgood | |

(Continued)

FOREIGN PATENT DOCUMENTS

| | | | |
|---|---|---|---|
| EP | 1479987 | A2 * | 11/2004 |
| JP | 4324073 | | 11/1992 |
| JP | 2002235989 | A * | 8/2002 |

OTHER PUBLICATIONS

English Abstract of JP432073 published Nov. 13, 1992 to inventor Takahiro et al. entitled "Cryogenic Refridgerating Plant."

(Continued)

*Primary Examiner* — Leonard R Leo
(74) *Attorney, Agent, or Firm* — Mary M. Lee

(57) ABSTRACT

A modular, water-to-air heat exchanger with flexible tubes is adjustable in length to conform to different size cooling coils and thus provides an inexpensive, retro-fittable run-around heat recovery for pre-existing air handling systems. The heat exchanger comprises multiple heat exchange tubes formed of flexible material in a shape that permits them to be lengthened or shortened by simply moving the headers toward or away from each other. Preferably, the tubes are formed of a flexible, non-resilient material such as copper, and are shaped in a serpentine or helical manner. In this way, the tubes can be drawn out to elongate the heat exchanger or compressed to shorten it, depending on the dimension of the cooling coil in the air handler. One convenient way to control the length of the flexible tubes is to support the headers on one or more adjustment bars, each having a threaded adjustment mechanism.

14 Claims, 4 Drawing Sheets

(56) References Cited

U.S. PATENT DOCUMENTS

| | | | | |
|---|---|---|---|---|
| 4,607,498 | A * | 8/1986 | Dinh | 165/104.21 |
| 4,778,004 | A | 10/1988 | Paulman et al. | |
| 4,832,113 | A * | 5/1989 | Mims et al. | 165/86 |
| 4,893,672 | A | 1/1990 | Bader | |
| 5,117,901 | A | 6/1992 | Cullimore | |
| 5,289,870 | A | 3/1994 | Dierbeck | |
| 5,323,848 | A * | 6/1994 | Naty et al. | 165/149 |
| 5,755,275 | A | 5/1998 | Rose et al. | |
| 5,921,315 | A * | 7/1999 | Dinh | 165/104.21 |
| 6,032,728 | A | 3/2000 | Ross et al. | |
| 6,119,769 | A | 9/2000 | Yu et al. | |
| 6,390,187 | B1 | 5/2002 | Marechal et al. | |
| 7,080,681 | B2 * | 7/2006 | Wert | 165/104.21 |
| 2006/0086482 | A1 | 4/2006 | Thayer et al. | |
| 2006/0260789 | A1 | 11/2006 | Nakagawa et al. | |

OTHER PUBLICATIONS

English translation of Japanese Patent Application Publication 2002-235989A (Appl No. 2001-33786) entitled Heat Exchanger, filed Feb. 9, 2001 and published Aug. 23, 2002.

* cited by examiner

FLEXIBLE HEAT EXCHANGER

This application claims the benefit of U.S. Provisional Application No. 60/866,115, filed Nov. 16, 2006, and the contents thereof are incorporated herein by reference.

FIELD OF THE INVENTION

The present invention relates to air handling equipment generally and, in particular but without limitation, to heat exchangers for air handlers.

BACKGROUND OF INVENTION

An "air handler" or "air handling system" is that portion of a central air conditioning system that moves the conditioned (cooled) air throughout a structure's ductwork or air flow enclosure. Air is forced by a fan through a cooling coil. If the fan is downstream of the cooling coil, the air handler is a "draw-through" type system. If the cooling coil is downstream of the fan, it is referred to as a "blow through" type air handler.

In a draw-through type system, some heat is added to the air by the fan after it is cooled. On the other hand, in the blow-through type system, the air is cooled downstream of the fan, so that the air entering the conditioned space is cooler. For this reason, blow-through air handling systems are preferred; because the air entering the space is cooler, less air is required to reach the desired room temperature. This, in turn, reduces the costs of the air handling system including the energy required to operate it efficiently.

Blow-through air handlers can be problematic in some applications, such as hospitals, pharmaceutical plants, and other facilities with "clean rooms," where the conditioned air is passed through a final air filter downstream of the cooling coil and prior to entering the space. Water from the nearly saturated air leaving the cooling coil sometimes condenses on the filter, eventually causing it to become soaked with moisture. Because the air leaving the coil is nearly saturated and because the temperature of this air fluctuates over such a small range, condensate in the filter has no opportunity to evaporate.

Thus, there is a need for blow-through air handling system that reduces condensate on air filters downstream of the cooling coil. There is a need for a heat exchanger system that can be retro-fitted to pre-existing air handlers plagued with wet air filters. There is a need for a simple reheat solution that will add as little as one-half to one degree Fahrenheit (0.5-1° F.) to the air leaving the cooling coil and before it enters the filter; this small amount of additional heat would reduce or eliminate condensation in the filter. There is a need for a simple reheat solution that is inexpensive to buy, to install, and to operate. There is a need for a reheat solution that would require no source of heated water or special electrical circuit. There is a need for a reheat solution that would require little or no modification to the air handler cabinet. There is a need for a reheat solution with a relatively low capacity so that its size and cost are minimized. There is a need for an adjustable run-around heat recovery system that can be sized for use with different size cooling coils, eliminating the need for expensive, customized options.

DESCRIPTION OF THE PREFERRED EMBODIMENT

Figure 2:
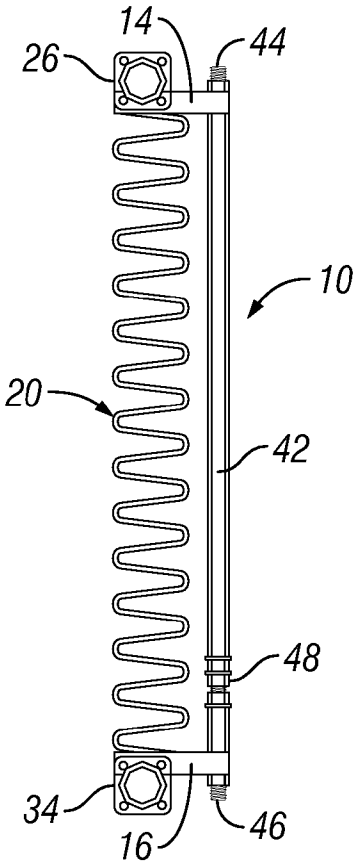
FIG. 2 is an elevational view of a first side of the heat exchanger of FIG. 1.
Figure 1:
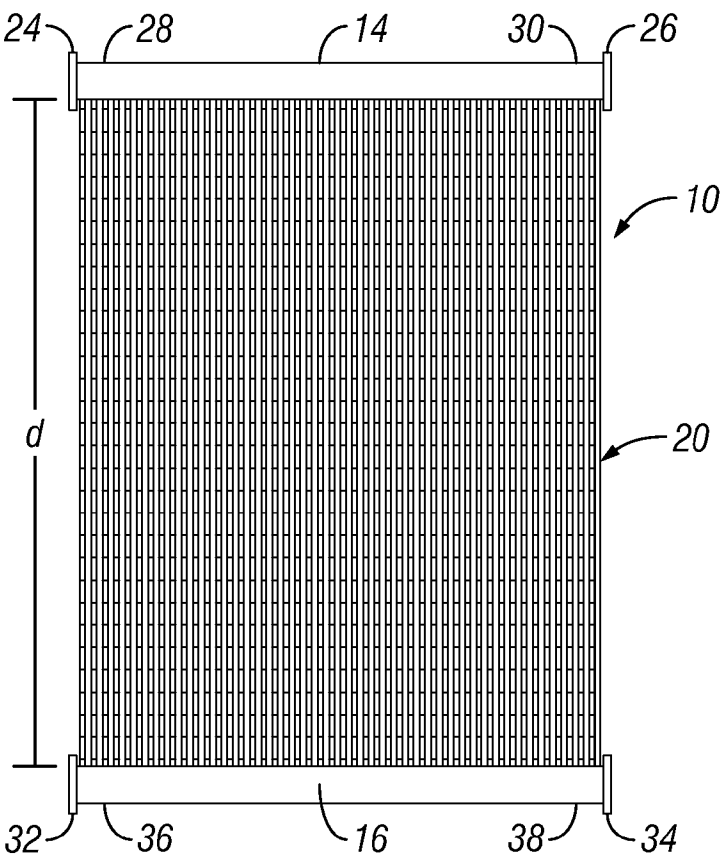
FIG. 1 is an elevational view of a first face of a heat exchanger constructed in accordance with the preferred embodiment.

Turning now to the drawings in general and to FIGS. 1 and 2 in particular, there is shown therein a modular heat exchanger made in accordance with the present invention and designated generally by the reference numeral 10. The heat exchanger 10 comprises first and second headers 14 and 16, the second header spaced a distance "d" from the first header.

Disposed between the first and second headers 14 and 16 are a plurality of heat exchange tubes, designated collectively at 20. The heat exchange tubes 20 are adapted to transfer heat between a heat exchange fluid, such as water, inside the tubes and air passing through the tubes. Each of the tubes 20 is made of a heat conductive material, such as copper.

The tubes 20 are connected to the headers 14 and 16 to provide communication therebetween. Thus, in a conventional manner, heat exchange fluid enters one header 14 or 16, passes through the heat exchange tubes 20, and then exits the heat exchanger through the other header. To allow the heat exchanger 10 to be connected to other like units or other fittings, each end of each header 14 and 16 preferably is provided with an end flange. Thus, as best seen in FIG. 1, the header 14 has end flanges 24 and 26 on its first and second ends 28 and 30, and the header 16 has end flanges 32 and 34 on its first and second ends 36 and 38.

With continuing reference to FIGS. 1 and 2, each of the plurality of tubes 20 has a resting length. As used herein, "resting length" refers to the length of the tube when no compression or tension is applied to it. In the preferred embodiment shown, the resting length of the tubes 20 is about the same as the distance "d" between the headers 14 and 16, as seen in FIG. 1.

Each of the tubes 20 is made of a flexible material and is characterized by a configuration that permits the resting length of the tube to be adjusted. In this way, the distance "d" between the first and second headers 14 and 16 can be adjusted. In the preferred embodiment, use of copper to form the tubes provides good flexibility as well as thermal conductivity.

In the embodiment shown in FIGS. 1 and 2, each of the tubes 20 is formed into a serpentine or sinusoidal pattern. Where the tubes are serpentine in shape, it may be desirable to arrange the tubes in an alternating fashion, so that adjacent tubes do not have fully overlapping curves. Another suitable configuration is helical. It will be appreciated that copper tubing in the illustrated serpentine shape may be easily stretched out to a length greater than the distance "d" or compressed to a length less than "d."

In the most preferred embodiment the tubes 20 are formed of a material that is non-resilient. As used herein, "non-resilient" denotes a material that is not elastic, that is, a material that, once deformed, retains the deformed shape rather than returning its original configuration. Though flexible, copper is non-resilient. Thus, in the embodiment shown, once the tubes 20 have been compressed, they will tend to retain the shorter, compressed position. Similarly, if pulled or stretched to elongate their length, the tubes 20 will tend to remain in the elongated position.

In most applications, it will be desirable that the tubes 20 be configured so that their resting length may be increased or decreased, that is, so that the heat exchanger 10 can be lengthened or shortened. However, in some embodiments, the heat exchanger 10 may comprise tubes that can only be compressed or can only be elongated. Additionally, while non-resilient material is preferred, in some applications a resilient material may be advantageous.

A particularly preferred means for controlling the length of the tubes 20 is to simply move the first and second headers 14 and 16 closer together or farther apart. Various ways to accomplish this will be apparent. One preferred way, illustrated in FIG. 2, is to use at least one and preferably two adjustment bars, one of which is designated at 42. The adjustment bar 42 preferably is fixed near the ends 30 and 38 of the headers 14 and 16 at the attachment point 44 and 46 and includes an adjustment mechanism, such as a threaded adjuster 48.

Threaded adjusters of this type are well known and, thus, are not shown or described in detail herein. Typically, such devices have two portions, one threadedly received in the other. The non-threaded ends are fixed axially relative to the outer portions of the adjustment bar; one is fixed against rotation, one is not. Thus, when the rotatable member is turned, the threads cause it to move towards or away from the mating threaded portion, thereby shortening or lengthening the adjustment bar 42.

Now it will be seen that the headers 14 and 16 and the adjustment bar 42 form a framework that supports the specially configured tubes 20 in a manner that preserves their parallel orientation relative to each other but which allows the overall length of the unit, or the distance "d," to be increased or decreased. Now it will be apparent that the preferred heat exchanger 10 is non-finned. This is acceptable because this particular heat exchanger is designed for flexibility, not efficiency.

Figure 3:
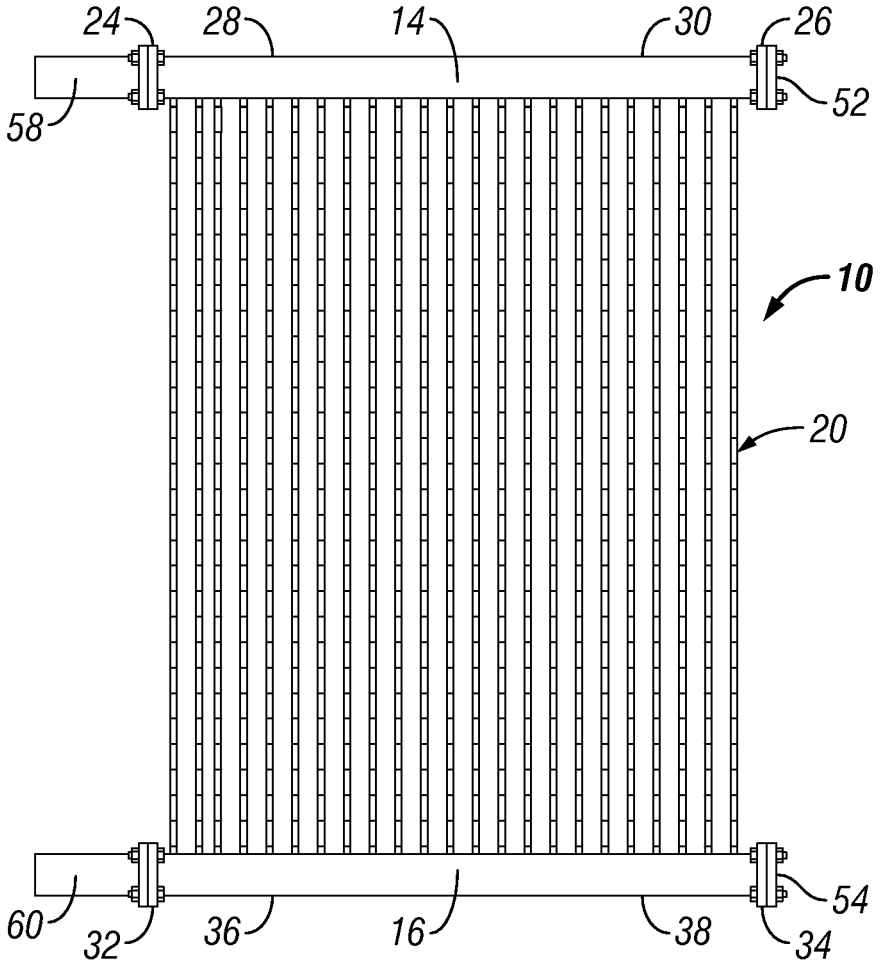
FIG. 3 is an enlarged elevational view of a first face of the heat exchanger of FIG. 1 with blind flanges connected to the end flanges on one end of the headers and connector flanges connected to the end flanges on the other end of the headers.

As shown in FIG. 3, the headers 14 and 16 with end flanges 24, 26, 32 & 34 may be equipped with fittings that permit the heat exchanger 10 to be used in a stand-alone mode, that is, not interconnected with other like units. To that end, the heat exchanger 10 shown in FIG. 3 may be provided with blind flanges 52 and 54 on the end flanges 26 and 34 and with connecting flanges 58 and 60 on the ends 28 and 36. The connecting flanges are used to connect the unit to the heat exchange fluid supply and return lines.

Figure 4:
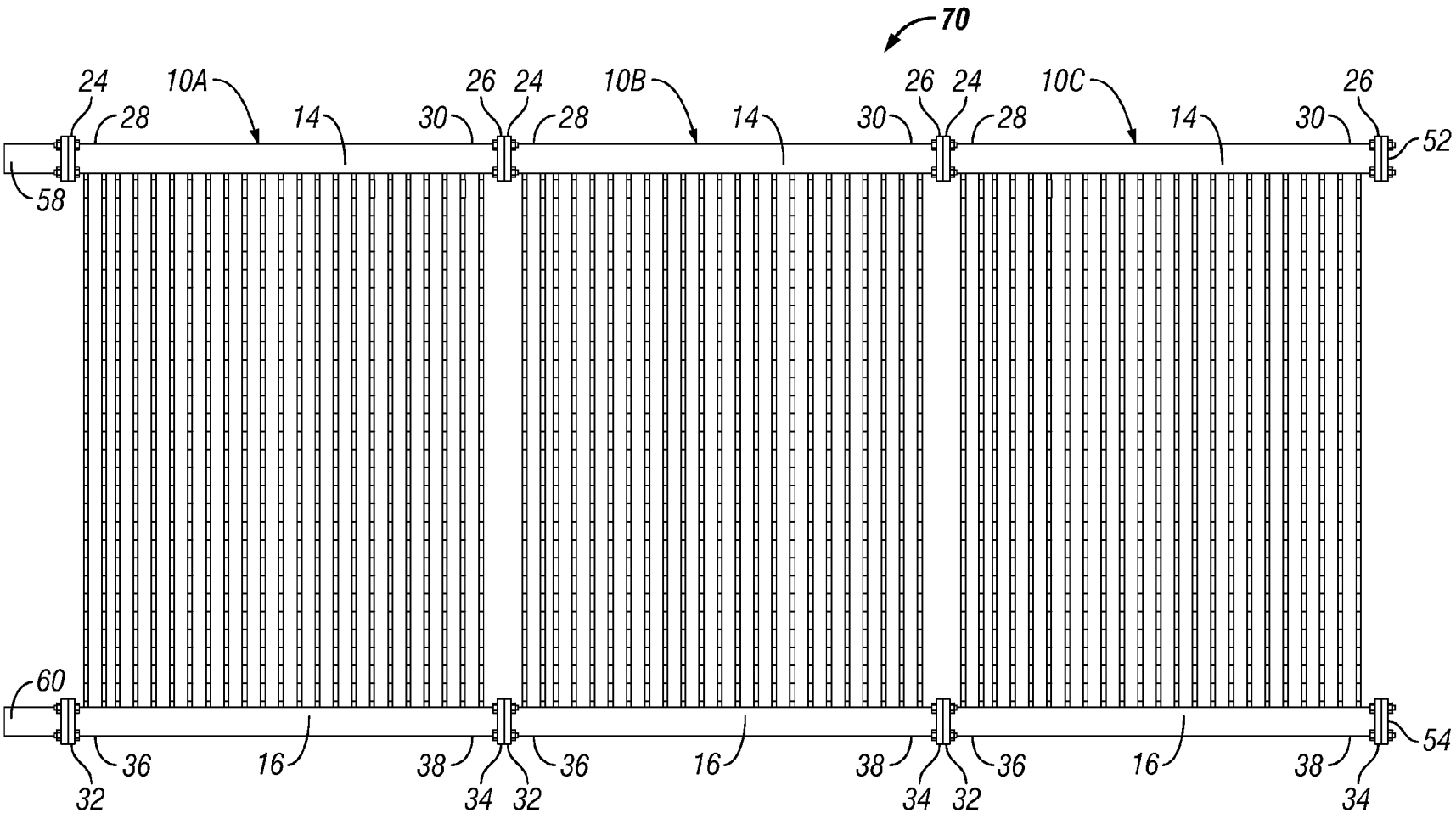
FIG. 4 is an elevational view of an array of three heat exchangers interconnected in series by connector flanges between units.

As shown in FIG. 4, the heat exchanger of the present invention is equipped with fittings that permit multiple, similarly formed heat exchangers designated as 10A, 10B and 10C to be connectable in series with other like units to form a bank or array 70 of heat exchangers. To that end, blind flanges 52 and 54 are attached to the end flanges 26 and 34 on the ends 30 and 38 of the headers 14 and 16 in the terminal unit 10C. The end flanges 26 and 34 of the first and second units 10A and 10B are connected directly to the end flanges 24 and 32 on the adjacent units 10B and 10C. Connecting flanges 58 and 60 are connected to the end flanges 24 and 32 of the first unit in the series, heat exchanger 10A.

Figure 5:
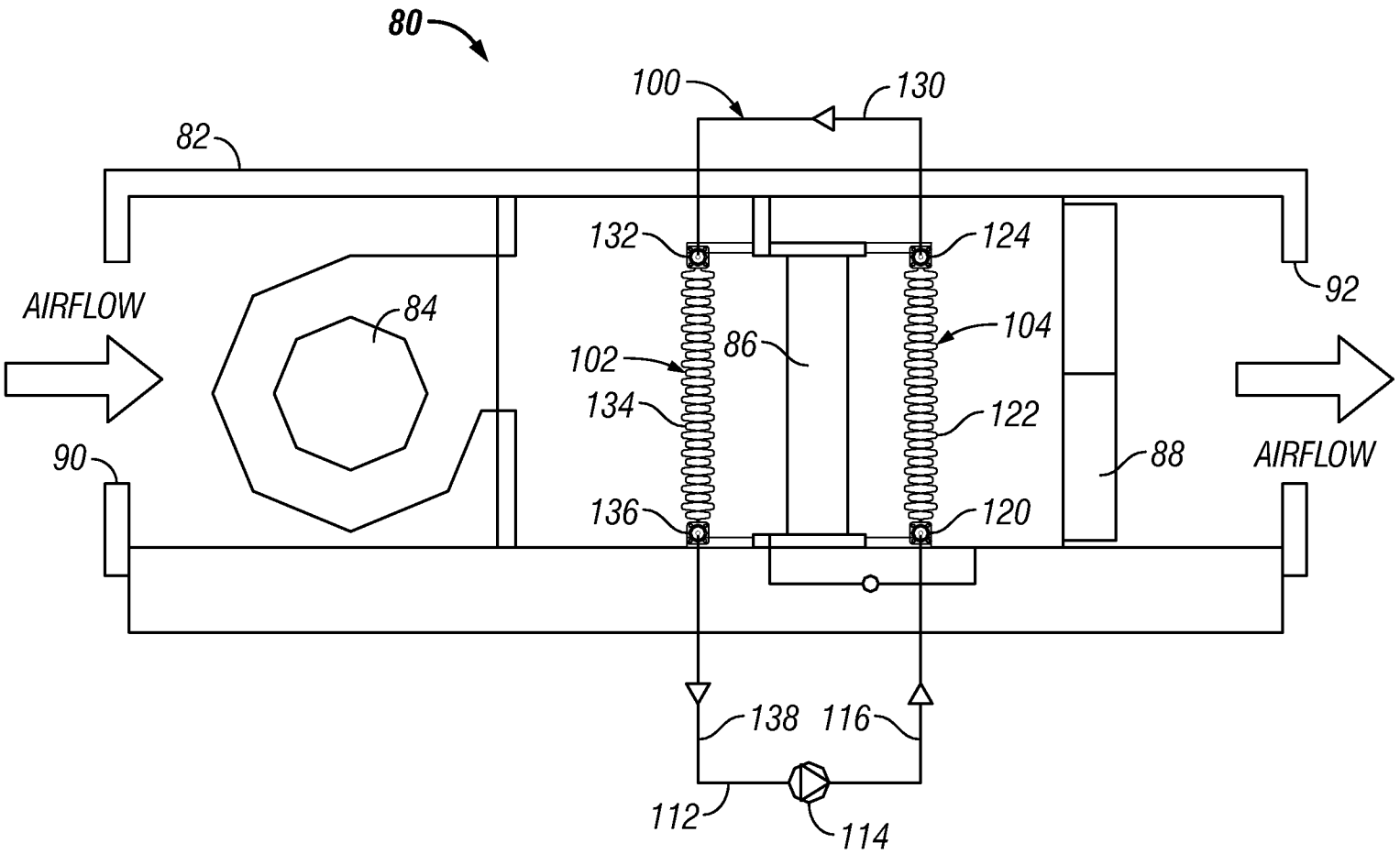
FIG. 5 is a schematic illustration of an air handler with a retro-fitted run-around heat recovery system in accordance with the present invention for reheating the air leaving the cooling coil before it blows through the filter. The adjustment bars in the heat exchangers have been omitted from this drawing for clarity of illustration.

Turning now to FIG. 5, there is shown therein the use of the heat exchanger 10 of the present invention to provide a retrofittable run-around heat recovery system in an existing blow-through air handling system designated generally at 80. The air handler 80 generally comprises an enclosure 82 and a fan 84 supported inside the enclosure. A cooling coil 86 is supported in the enclosure 82 downstream of the fan, and an air filter 88 is provided downstream of the cooling coil. The air enters at the inlet end 90 and exits into the conditioned space at the outlet end 92.

Also included in the system 80 is a "run-around" heat recovery system 100 in accordance with the present invention and incorporating the previously described heat exchanger. The heat recovery system 100 includes a first or upstream heat exchanger 102 and a second or downstream heat exchanger 104. The upstream heat exchanger 102 is supported in the enclosure 82 between the fan 84 and the cooling coil 86. The downstream heat exchanger 104 is supported in the enclosure 82 between the cooling coil 86 and filter 88. Each of the heat exchangers 102 and 104 is structurally similar to the heat exchanger 10 in FIGS. 1 and 2 or to the array 70 of heat exchangers in FIG. 4.

Although the heat exchangers and the run-around heat recovery systems of the present invention are ideally suited for use in blow-through handlers with downstream filters, such as the air handler shown in FIG. 5, the present invention is not so limited. Rather, this technology has other applications. For example, the inventive heat recovery system 100 is useful in an air handler with a downstream sound attenuator in which condensation is occurring.

During installation of the heat recovery system 100, the length of the heat exchangers 102 and 104 are adjusted in the manner described previously so that they are about the same length as the cooling coil 86. If the cooling coil 86 is significantly wider than a single heat exchanger, then two or more heat exchangers can be interconnected in series as previously described. In this way, it is possible to ensure that all air entering the cooling coil 86 will pass through the heat exchanger 102 and likewise that all air leaving the coil will pass through the heat exchanger 104. This ensures that all of the air is de-saturated.

The heat exchangers 102 and 104 are connected in a circulation loop by means of a conduit 112. A pump 114 is provided for circulating heat exchange fluid through the conduit 112. Heat exchange fluid (not shown) passes from the pump 114 through the conduit segment 116 into the end 120 of the bottom header (not numbered) of the downstream heat exchanger 104, flows up through the heat exchange tubes 122 and out the end 124 of the top header (not numbered). Next, the fluid flows through the connecting loop 130 of the conduit 112 and into the end 132 of the upper header (not numbered) on the upstream heat exchanger 102. After passing down through the heat exchange tubes 134, the fluids exits the end 136 of the bottom header (not numbered) and returns to the pump 114 through the conduit segment 138.

Through this continuous flow pattern, a small amount of heat is removed from the air passing through the upstream heat exchanger 102, and this heat—usually one-half to one degree Fahrenheit (0.5-1.0° F.)—is returned to the air by the downstream heat exchanger 104 as it exits the cooling coil 86 and before it enters the filter 88. Thus, the slightly increased temperature of the cooled air entering the filter 88 causes it to be slightly less saturated resulting in less condensation.

Now it will be appreciated that the present invention provides a modular water-to-air heat exchanger that can be used in run-around heat recovery system that is retro-fittable into pre-existing air handlers. Because of the flexibility of the heat exchanger tubes, the heat exchanger can be installed on cooling coils that have a wide range of fin heights. This modular construction, in conjunction with the flexible heat exchange tubes, allows a few models of heat exchangers to fit a very wide variety of cooling coil sizes and to completely cover the downstream face of the cooling coil. Additionally, since the heat exchanger does not have to be very effective, the heat exchanger tubes do not need to be finned. The flexible heat exchanger of the present invention eliminates the need for custom-made units, and thus provides a low cost alternative for run-around heat recovery systems in air handlers with chronic wet filter problems.

What is claimed is:

1. An air handler comprising:

an air flow enclosure;

a fan supported in the enclosure;

a cooling coil supported in the enclosure downstream of the fan, the coil having a length and a downstream face;

a first heat exchanger adapted to transfer heat between a heat transfer fluid inside and air passing therethrough and supported in the enclosure upstream of the cooling coil;

a second heat exchanger adapted to transfer heat between a heat transfer fluid inside and air passing therethrough and supported in the enclosure downstream of the cooling coil; and a conduit system fluidly connecting the first and second heat exchangers and comprising a fluid pump for circulating heat exchange fluid therebetween;

wherein at least one of the first and second heat exchanger is a modular heat exchanger comprising:

a first header;

a second header supported a distance from the first header; and a plurality of heat exchange tubes adapted to transfer heat between fluid inside the tubes and air passing through the tubes, wherein the plurality of heat exchange tubes are disposed between the first and second headers and are connected to provide fluid communication therebetween, wherein each of the plurality of heat exchange tubes has a resting length, is made of a flexible material, and is characterized by a configuration that permits the resting length of the tube to be adjusted, whereby the distance between the first and second header can be adjusted to about the same as the length of the cooling coil so that the downstream face of the cooling coil is covered by the heat exchanger; and wherein the plurality of heat exchange tubes and the first and second headers were assembled as a module prior to installation in the air handler and were configured for installation in a pre-existing air handler.

2. The air handler of claim 1 wherein the configuration of each of the plurality of heat exchange tubes is serpentine.

3. The air handler of claim 2 wherein adjustment of the resting length of each of the plurality of heat exchange tubes includes increasing and decreasing the resting length.

4. The air handler of claim 3 wherein the material of which the plurality of heat exchange tubes is made is non-resilient.

5. The air handler of claim 1 wherein adjustment of the resting length of each of the plurality of heat exchange tubes includes increasing and decreasing the resting length.

6. The air handler of claim 5 wherein the material of which the plurality of heat exchange tubes is made is non-resilient.

7. The air handler of claim 1 wherein the resting length of each of the plurality of heat exchange tubes is adjusted by moving the first and second headers closer together or farther apart.

8. The air handler of claim 7 further comprising at least one adjustment bar extending between the first and second headers adapted to move the first and second headers closer together or farther apart.

9. The air handler of claim 8 wherein the at least one adjustment bar comprises a threaded adjustment means for lengthening and shortening the bar.

10. The air handler of claim 7 wherein the material of which the plurality of heat exchange tubes is made is non-resilient.

11. The air handler of claim 10 wherein adjustment of the resting length of each of the plurality of heat exchange tubes includes increasing and decreasing the resting length.

12. The air handler of claim 1 wherein the plurality of heat exchange tubes is non-finned.

13. The air handler of claim 1 wherein each of the first and second headers has a first and second end, wherein each of the first and second ends is provided with a connection flange whereby the modular heat exchange is connectable in series with other like modular exchangers.

14. The air handler of claim 1 further comprising an air filter supported in the enclosure downstream of the second heat exchanger.

* * * * *